US006843401B2

(12) United States Patent
Favre-Bulle

(10) Patent No.: US 6,843,401 B2
(45) Date of Patent: Jan. 18, 2005

(54) FUEL DRIVEN SETTING TOOL

(75) Inventor: Bernard Favre-Bulle, Feldkirch-Tosters (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/723,155

(22) Filed: Nov. 24, 2003

(65) Prior Publication Data

US 2004/0104258 A1 Jun. 3, 2004

(30) Foreign Application Priority Data

Nov. 26, 2002 (DE) ..... 102 54 965

(51) Int. Cl.[7] ..... B25C 1/14
(52) U.S. Cl. ..... 227/10; 227/130; 123/46 SC
(58) Field of Search ..... 227/10, 9, 130, 227/131, 156; 123/46 SC

(56) References Cited

U.S. PATENT DOCUMENTS 4,483,280 A * 11/1984 Nikolich ..... 123/46 SC
4,773,581 A * 9/1988 Ohtsu et al. ..... 227/10
6,247,626 B1 * 6/2001 MacVicar ..... 227/10
6,318,615 B1 * 11/2001 Walter ..... 227/10
6,491,002 B1 * 12/2002 Adams ..... 123/46 R
6,619,527 B1 * 9/2003 Moeller ..... 227/10

* cited by examiner

*Primary Examiner*—Scott A. Smith
(74) *Attorney, Agent, or Firm*—Sidley Austin Brown & Wood, LLP

(57) ABSTRACT

The present invention relates to a fuel-driven setting tool (10) for driving fastener elements such as nails, bolts, and pins into a substrate. The tool has a setting piston (13) guided in a piston guide (12) and displaceable using the combustion energy of a propellant and having a voltage source for supplying an electrical consumer on the setting tool (10). For improving a setting tool of this type, a generator device (30, 40) can be provided for transforming setting energy from the combustion of the propellant into electrical energy.

11 Claims, 5 Drawing Sheets

FUEL DRIVEN SETTING TOOL

BACKGROUND OF THE INVENTION

The present invention relates to a fuel-driven setting tool for driving fastener elements such as nails, bolts, pins and the like into a substrate. The setting tool has a setting piston guided in a piston guide, is displaceable using the combustion energy of a propellant, and has a voltage source for supplying electrical consumers on the setting tool. Such setting tools can be driven using gaseous, vaporizable fluids or solid fuels. A setting piston is driven, in the fuel-driven setting tools, in the setting operation by combustion gases. The fastening elements can be driven into a substrate by the setting piston. Thermal energy is produced, in the setting operation with the kinetic energy of the moving setting piston, which, if required, is diverted over a cooling system, such as cooling ribs or fins etc. to the environment.

Setting tools of this type generally comprise electronic components such as electronically controlled valves, ignition systems, fans, sensors, etc. These components and their control systems must be supplied with electrical energy such that independence of electrical mains is desirable.

U.S. Pat. No. 4,403,722 discloses a gas-driven setting tool, in which the air and fuel gas mixture in the combustion chamber is homogenized by an electrically driven fan prior to ignition. A NiCd storage battery provides electrical power to the fan drive and its control system.

The drawback is that the NiCd storage battery must be recharged by an external energy source. The storage batteries must be removed from the setting tool, which is relatively inconvenient for the user.

U.S. Pat. No. 6,123,241 discloses a gas driven setting tool, wherein an extensive electronic control system controls and/or monitors different electronic systems. Different sensors such as temperature, pressure and work surface temperature sensors, an electronic ignition and an electronically driven fan are arranged on the setting tool. Two electrical power sources are required for supplying power to this setting tool. An alkaline battery supplies the microprocessor, which is the nucleus of the controls, with electrical energy and a lead-acid battery is the main battery. In this setting tool, external recharging of the lead-acid battery is required.

A fuel-driven setting tool is known from DE 40 32 303 A1, in which permanent magnets are arranged on one wall of the combustion chamber facing the piston for temporarily holding the piston.

SUMMARY OF THE INVENTION

The object of the present invention is to develop a setting tool that can operate independent of a fixed location and which eliminates the aforementioned drawbacks.

This object is achieved according to the invention by a fuel-driven setting tool having a setting piston guided in a piston guide, being displaceable by the combustion energy of a propellant and having a voltage source for supplying electrical consumers on the setting tool, wherein the voltage source has a generator device for transforming setting energy from the combustion of the propellant into electrical energy.

At least part of the energy of the setting process, in the generator device, is used to produce electrical energy. It is possible to electrically re-charge a storage battery, capacitor or other storage means for electrical energy that may be present in the setting tool, directly using the energy released in a setting operation by virtue of the process according to the invention. The generator device can be configured such that the kinetic energy released in the setting tool, at the time of a setting operation, is at least partially converted into electrical energy. The kinetic energy can then be picked up by the driving piston moving in the setting process or by a piston guide and/or a bolt guide moving relative to the housing at the time of a contact or application process of the setting tool on a substrate. This kinetic energy is released at each setting operation and need not be separately supplied.

Likewise, it can be advantageous, if the generator device is configured such that the thermal energy released at the time of a setting operation is converted into electrical energy. The generator device is preferably disposed relatively close to the combustion chamber or to the combustion space or, in powder or tablet-driven setting tools, close to the cartridge holder, where the highest temperatures are present due to the combustion process of a propellant means in the setting tool. Also, thermal energy is present at the time of every setting operation without the necessity of additional operations.

In one advantageous embodiment, the generator device comprises a coil arrangement comprising one or a plurality of windings with magnetic cores that are arranged in or on the combustion chamber wall or cartridge chamber wall facing the setting piston. In the upper return [dead] position of the setting piston, the setting piston is situated very close to the coil arrangement and is in direct or indirect contact with the magnets such that the magnetic flux continues into the setting piston. If the setting piston is in the sequence of a triggered setting operation, whereby the expanding combustion gases generated by the combustion of a propellant rapidly accelerate to a high speed, the setting piston effects a change in the permanent magnet field. By virtue of this flux change, the magnetic energy is converted to electrical energy in the coils. This energy can be used directly or indirectly to supply electrical consumers in the setting tool.

It can be further advantageous, if a control device is provided in the setting tool, which is electrically connected with the coil arrangement. This control device, which can include a controlled rectifier and a DC/DC converter, such as the voltage pulses that are generated with each setting operation, can be converted into a continuous d.c. voltage of a defined level on the load or on the electrical consumers. A capacitor or storage battery can also be charged after rectifying and can be arranged upstream of the consumer(s).

Especially in the case of gas-driven setting tools, it can be of advantage if the magnetic elements or the permanent magnets are configured as piston mounting means. In this fashion, the setting piston can be held at the combustion chamber upon triggering of a setting operation until sufficiently high pressure builds up in the combustion chamber and an isochoric combustion can take place in the combustion chamber before the setting piston releases from the combustion chamber. The magnetic elements perform the function of the piston mounting arrangement when they are in direct contact with the metal setting piston and the piston is situated in its upper return position. The function of the magnetic elements as piston mounting means is also effective when pole shoes are provided that further conduct the magnetic flux from the magnetic elements or the permanent magnets to the setting piston.

In a further advantageous embodiment of the invention, the generator device has an array of Peltier elements, which are thermally coupled to the combustion chamber and/or to the cartridge chamber of the setting device. An electrical voltage is generated by the Peltier element array using the Peltier effect and this electrical voltage is converted to a current in a connected consumer. The voltage is generated at the Peltier elements such as Peltier semiconductors. It can be advantageous, if the Peltier element array has a plurality of layers of Peltier elements that are carried by insulators such as ceramic insulators. Preferably, in this type of generator device, an electrical control device is provided that is connected to the Peltier element array. This control device is used for stabilizing and maintaining the necessary load d.c. voltage, whereby the control device can have at least one capacitor and a d.c./d.c. transformer.

BRIEF DESCRIPTION OF THE INVENTION

Other advantages and features of the invention are apparent from the following description with reference to the drawings wherein.

DETAILED DESCRIPTION OF THE INVENTION

Figure 1:
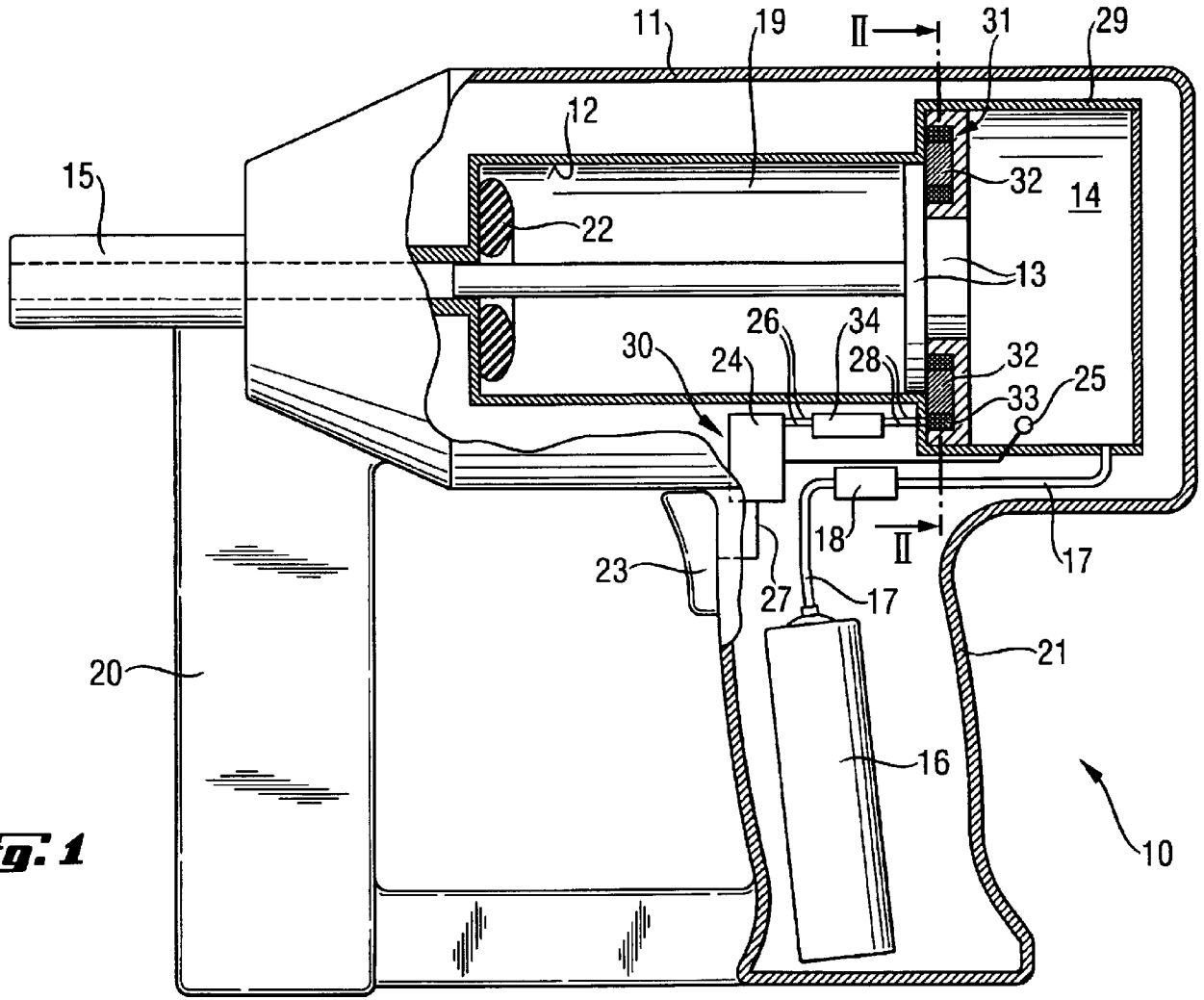
FIG. 1 shows a setting tool, in partial longitudinal section, according to the invention.
Figure 2:
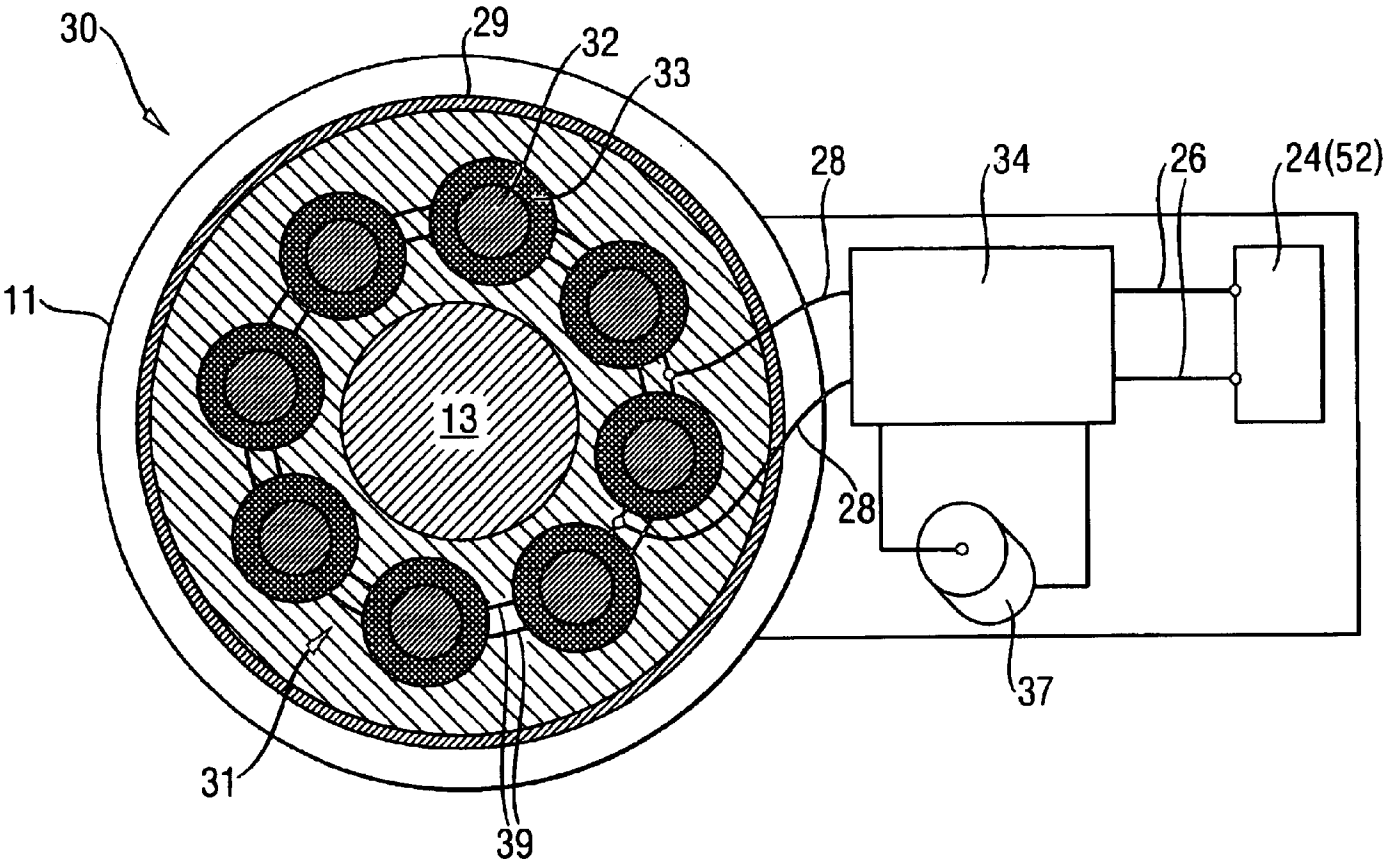
FIG. 2 shows the setting tool of FIG. 1, in cross-section along the line II—II of FIG. 1, and in partial representation.
Figure 3:
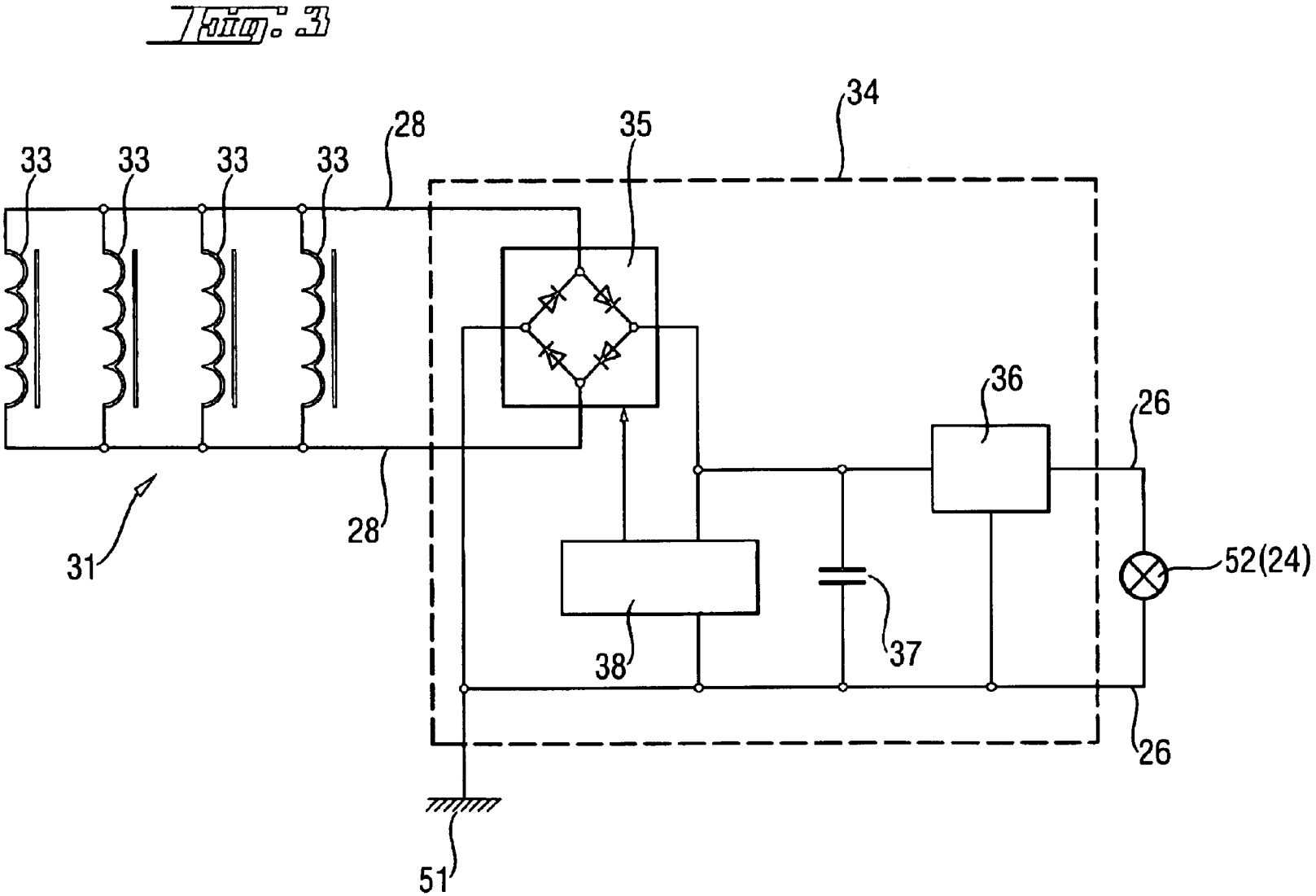
FIG. 3 shows a generator device of a setting tool according to FIG. 1.

In FIGS. 1 to 3, a first embodiment of a setting tool 10 according to the invention is shown in its resting or starting position. The setting tool 10 has a single piece or multipart housing part, generally identified using 11, in which the setting mechanism is arranged. Using the setting tool, a fastener such as a nail, bolt, etc. can be driven into a substrate (not shown), when the setting tool 10 is pressed onto a substrate with its bolt guide 15 and fired.

The setting mechanism comprises a combustion chamber 14, a piston guide 12, in which a setting piston 13 is axially displaceable and a bolt guide 15, in which a fastener can be guided and where a fastener, during a setting operation, moves over the forward advancing, setting end of the setting piston 13 or its piston rod and can be driven into a substrate. When this is done, the bolt guide 15 makes contact at the piston guide 12 in the setting direction. In the forward end region of the piston guide 12, additional damping elements 22 are provided that buffer the impact of the setting piston 13 rushing forward in the setting operation. The fasteners can be supplied in a magazine 20 on the setting tool 10. The setting tool 10, in the present exemplary embodiment, can be operated with a fuel gas or with a damp liquid fuel in a fuel reservoir 16 or a fuel canister, fuel tank or the like. A fuel line 17 branches off from the fuel reservoir 16 and leads off to the combustion chamber 14. A dosing device 18 is arranged in the fuel line 17 and supplies only the required fuel quantity to the combustion chamber 14 that is required for a setting operation. The setting tool can also be operated using solid or powdered fuel, such as cartridge propellant charges.

In the present exemplary embodiment, a control device 24 is provided or, if required, sensors can be provided (not shown diagrammatically here) for controlling the dosing device 18, an ignition device 25, such as a spark plug, and can co-operate with the control device 24. The control device 24 is connected via an electrical line 27 to a trigger switch 23 on the handle 21 of the setting tool 10, which triggers the setting operation. The aforesaid devices generally represent electrical consumers 52 that must be supplied with electrical energy.

A mains-independent power supply is in the setting tool 10, such as generator device 30. This generator device 30 comprises a coil arrangement 31 with a plurality of coils 33 that are each arranged around a magnetic element 32 such as a permanent magnet. The individual coils 33 are wired in parallel to each other (FIG. 2) using electrical lines 39. It is, however, also possible, to connect the coils 33 in series. The coil arrangement 31 is connected to a control device 34, in FIGS. 2 and 3, by electrical lines 28. This control device 34 (FIG. 3) has a rectifier 35, a d.c./d.c. transformer 36, an electrical storage 37, a voltage regulator 38 and a grounding connection 51. A full-wave rectifying of the electrical current is performed by the controlled rectifier 35, which then charges the current storage 37 such as a capacitor or storage battery. Using the d.c./d.c. transformer 36, voltage fluctuations of the current storage 37 as a result of different charge conditions is balanced out to a certain degree. The voltage regulator 38, the rectifier 35, which is preferably a full-wave rectifier, causes the current flow to flow in one direction regardless of the polarity of the voltage polarity induced in the coils 33, by virtue of its semiconductor valves. The current storage 37 is charged by virtue of the rectified current. The controller 38 addresses the semiconductor valves such that the current storage 37 is charged to a predefined voltage. The controller 38 thus fulfills the task of a voltage controller. If the voltage of the current storage 37 rises above the rated level, the regulator 38 prevents further charging of the current storage 37 by shutting the semiconductor valves and thus preventing an undesirable further voltage rise at the current storage 37.

The control device 34 is connected with the consumers 52, such as the control device 24, over electrical lines 26. Electrical energy is generated by the generator device 30 at each movement of the setting piston 13 in a setting operation. In the resting position of the setting device 10 shown in FIG. 1, the setting piston 13 is in its upper return position directly in contact with the combustion chamber 14. In this position, the setting piston. 13 is held with a specific force by the magnetic elements 32, which in this instance acts with their function in the generator device 30, as piston mounting means. If the user of the setting tool 10 triggers a setting operation by the trigger switch 23, a fuel-air mixture in the combustion chamber 14 is ignited by an ignition device 15. A change in the permanent magnetic field of the magnetic elements 32 is produced by the rapid acceleration of the setting piston 13 to a high speed. Magnetic energy is inductively converted to electrical energy due to the change in the magnetic flux produced in the coils 33. This energy is made available to the consumers 52 via the generator device 30.

Figure 4:
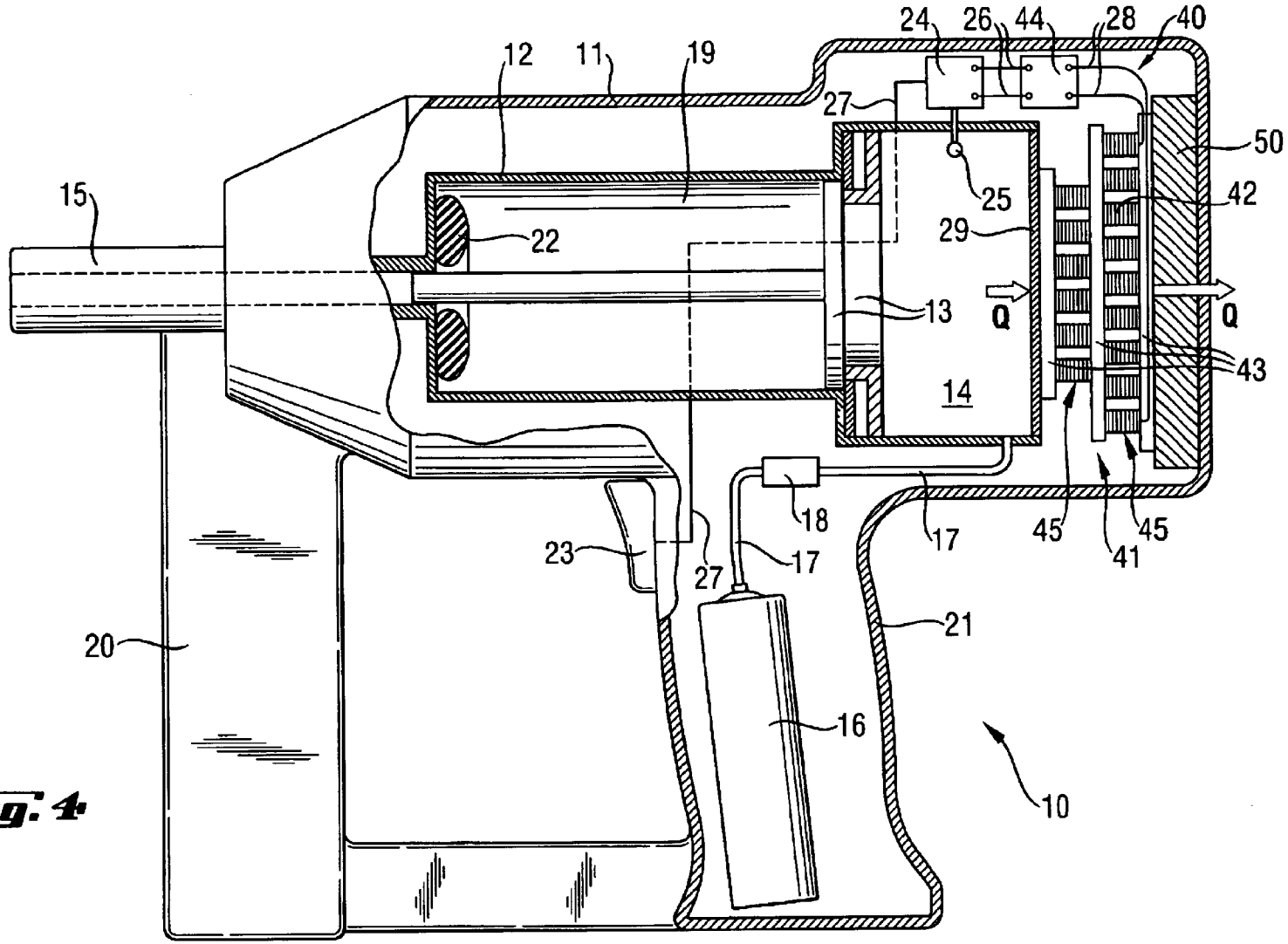
FIG. 4 shows a second embodiment of a setting tool according to the invention partially in longitudinal section.
Figure 5:
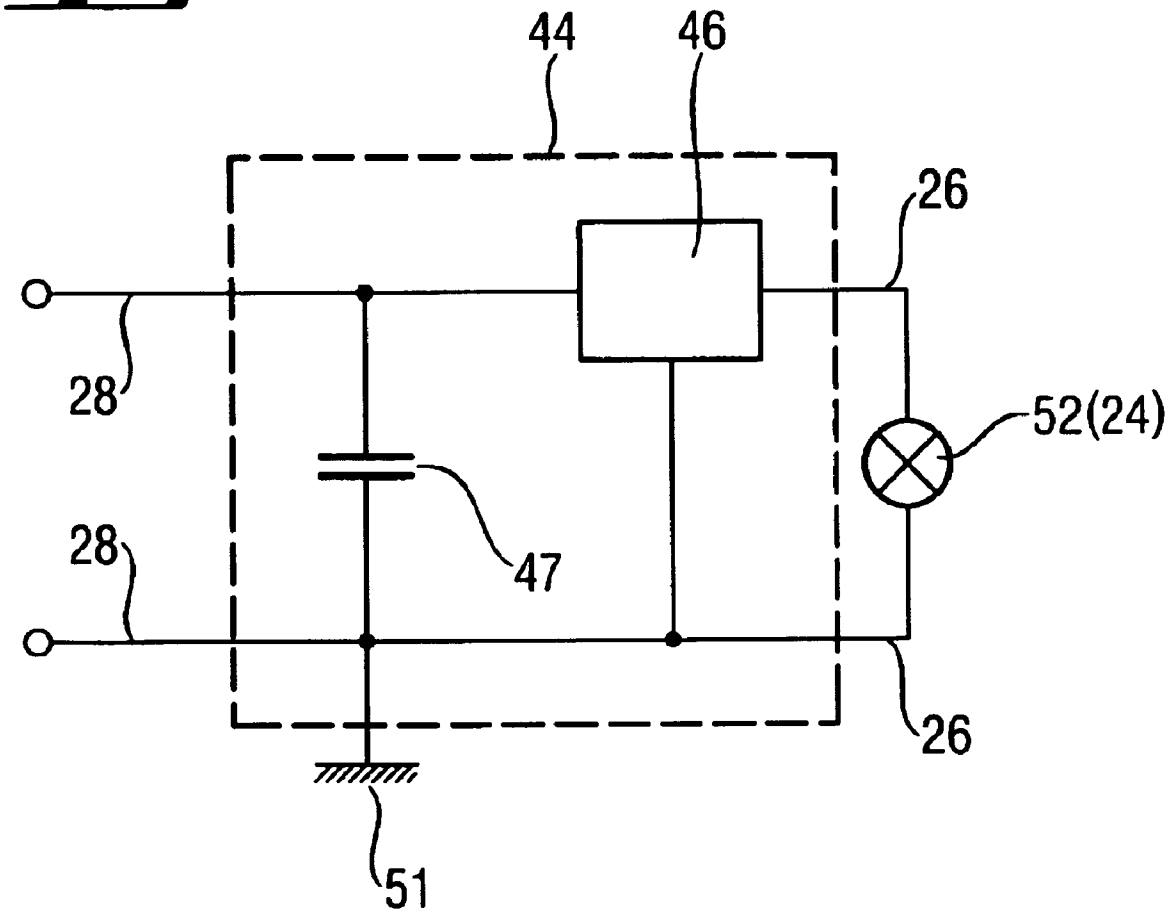
FIG. 5 shows a generator device of a setting tool according to FIG. 4.

In FIGS. 4 to 5, a second embodiment of a setting tool 10 according to the invention is shown in its resting or starting position. The setting tool differs from the setting tool shown in FIGS. 1 to 3 in that the electrical energy is supplied by a differently configured generator device 40. While in generator device 30 of FIGS. 1 to 3, kinetic setting energy is converted to electrical energy and thus the thermal energy is released at the time of combustion, the propellant is used by the generator device 40 for the production of electrical energy.

The generator device 40 includes an arrangement 41 of Peltier elements 42, that is arranged external to the combustion chamber 14 on a combustion chamber wall 29 and which produces electrical energy from the heat Q generated at the time of combustion in the combustion chamber 14. In this instance, the Peltier elements 42 are arranged in layers that are separated from each other by insulators 43. A cooling element 50 is arranged on a side of the arrangement 41 facing away from the combustion chamber wall 29, and the cooling element diverts the heat Q to the environment.

The Peltier element array 41 is connected to a control device 44 via the electrical lines 28. This control device 44 contains a d.c./d.c. transformer 46, a current storage 47 and a ground connection 51 (FIG. 5). Voltage fluctuations of the current storage 47 due to different charge conditions are balanced out to a certain degree using the d.c./d.c. transformer 46. The control device 44 is then connected over electrical lines 26 with the consumers 52, such as the control device 24. Electrical energy continues to be generated by the generator device 40 via the Peltier effect as long as a sufficient temperature gradient exists between the combustion chamber 14 and the environment.

Reference is made to the description relative to FIGS. 1 to 3 regarding the technical details that are not explicitly described here.

What is claimed is:

1. A fuel-driven setting tool for driving fastener elements comprising one of nails, bolts, and pins into a substrate having a setting piston (13) guided in a piston guide (12) and displaceable using the combustion energy of a propellant and having a voltage source for supplying an electrical consumer on the setting tool, wherein the voltage source has a generator device (30, 40) for transforming setting energy from the combustion of the propellant into electrical energy.

2. The setting tool of claim 1, wherein the generator device (30) transforms kinetic energy into electrical energy.

3. The setting tool of claim 1, wherein the generator device (40) transforms heat energy into electrical energy.

4. The setting tool of claim 1, wherein the generator device (30) has a coil arrangement (31) comprising magnetic elements (32) and associated coils (33) comprised of electrically conductive material, wherein the magnetic elements (32) co-operate with the setting piston (13).

5. The setting tool of claim 4, wherein the coil arrangement (31) is electrically connected with a control device (34).

6. The setting device of claim 5, wherein the control device (34) has a rectifier (35) and a d.c./d.c. transformer (36).

7. The setting tool of claim 4, wherein the magnetic elements (32) are piston mounting means for temporarily holding the setting piston (13) at a combustion chamber (14).

8. The setting tool of claim 1, wherein the generator device (40) has an arrangement (41) of Peltier elements (43), and wherein the arrangement (41) of Peltier elements (42) is thermally coupled to the combustion chamber (14) of the setting tool (10).

9. The setting tool of claim 8, wherein a plurality of Peltier elements (42) are arranged between insulators (43) in a plurality of layers (45).

10. The setting tool of claim 8, wherein the arrangement (41) of Peltier elements (42) is electrically connected to a control device (44).

11. The setting tool of claim 10, wherein the control device (44) has a d.c./d.c. transformer (46).

* * * * *